US011668012B2

(12) United States Patent
Ding et al.

(10) Patent No.: US 11,668,012 B2
(45) Date of Patent: Jun. 6, 2023

(54) METHODS FOR PRODUCING HYDROCARBON PRODUCTS AND HYDROGEN GAS THROUGH ELECTROCHEMICAL ACTIVATION OF METHANE

(71) Applicant: Battelle Energy Alliance, LLC, Idaho Falls, ID (US)

(72) Inventors: Dong Ding, Idaho Falls, ID (US); Ting He, Idaho Falls, ID (US); Wei Wu, Idaho Falls, ID (US); Yunya Zhang, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 0 days.

(21) Appl. No.: 16/196,283

(22) Filed: Nov. 20, 2018

(65) Prior Publication Data

US 2019/0177861 A1 Jun. 13, 2019

Related U.S. Application Data

(60) Provisional application No. 62/597,004, filed on Dec. 11, 2017.

(51) Int. Cl.
*C25B 3/03* (2021.01)
*C25B 3/23* (2021.01)
(Continued)

(52) U.S. Cl.
CPC ..... *C25B 3/00* (2013.01); *C25B 1/02* (2013.01); *C25B 9/19* (2021.01); *C25B 11/077* (2021.01); *C25B 11/081* (2021.01); *C25B 13/04* (2013.01)

(58) Field of Classification Search
CPC .... C25B 1/02; C25B 3/02; C25B 3/03; C25B 3/23
(Continued)

(56) References Cited

U.S. PATENT DOCUMENTS 5,064,733 A 11/1991 Krist et al.
5,244,753 A 9/1993 Taniguchi et al.
(Continued)

FOREIGN PATENT DOCUMENTS

CN 102515750 A * 6/2012 ..... C04B 35/48
JP 2015147998 A * 8/2015 ..... C25B 13/04
WO 2016/178948 A1 11/2016

OTHER PUBLICATIONS

Wang et al., "Perovskite-Based Mixed Protonic-Electronic Conducting Membranes for Hydrogen Separation: Recent Status and Advances," Journal of Industrial and Engineering Chemistry (Apr. 25, 2018), vol. 60, pp. 297-306. (Year: 2018).*
(Continued)

*Primary Examiner* — Edna Wong
(74) *Attorney, Agent, or Firm* — TraskBritt

(57) ABSTRACT

A method of forming a hydrocarbon product and hydrogen gas comprises introducing $CH_4$ to a positive electrode of an electrochemical cell comprising the positive electrode, a negative electrode, and a proton-conducting membrane between the positive electrode and the negative electrode. The proton-conducting membrane comprises an electrolyte material having an ionic conductivity greater than or equal to about $10^{-2}$ S/cm at one or more temperatures within a range of from about 150° C. to about 600° C. A potential difference is applied between the positive electrode and the negative electrode of the electrochemical cell to produce the hydrocarbon product and the hydrogen gas. A $CH_4$ activation system and an electrochemical cell are also described.

8 Claims, 1 Drawing Sheet

(51) Int. Cl.

| | |
|---|---|
| ***C25B 3/00*** | (2021.01) |
| ***C25B 13/04*** | (2021.01) |
| ***C25B 1/02*** | (2006.01) |
| ***C25B 9/19*** | (2021.01) |
| ***C25B 11/077*** | (2021.01) |
| ***C25B 11/081*** | (2021.01) |

(58) Field of Classification Search
USPC ..... 205/462, 637
See application file for complete search history.

(56) References Cited

U.S. PATENT DOCUMENTS

| | | | | |
|---|---|---|---|---|
| 6,332,968 | B1 | 12/2001 | Mazanec et al. | |
| 9,281,525 | B2 | 3/2016 | De Miranda et al. | |
| 9,724,640 | B2 | 8/2017 | Joo et al. | |
| 2005/0026006 | A1 | 2/2005 | Haile et al. | |
| 2008/0283411 | A1* | 11/2008 | Eastman | C10G 2/50 205/343 |
| 2008/0318094 | A1 | 12/2008 | Ginosar et al. | |
| 2010/0233056 | A1* | 9/2010 | Luo | C04B 35/50 423/263 |
| 2011/0183221 | A1 | 7/2011 | Serra Alfaro et al. | |
| 2011/0262839 | A1* | 10/2011 | Kang | H01M 8/126 429/496 |
| 2013/0118910 | A1 | 5/2013 | Teamey et al. | |
| 2014/0272667 | A1 | 9/2014 | Haile et al. | |
| 2015/0119542 | A1* | 4/2015 | Weissman | C07C 29/04 526/348 |
| 2016/0204444 | A1 | 7/2016 | Tong et al. | |
| 2017/0288248 | A1* | 10/2017 | Mikami | H01M 4/9033 |
| 2018/0363150 | A1* | 12/2018 | Alvarez | C25B 13/04 |
| 2019/0284048 | A1* | 9/2019 | Kjolseth | C01B 3/26 |

OTHER PUBLICATIONS

Matsumoto et al., "Proton-Conducting Oxide and Applications to Hydrogen Energy Devices," Pure and Applied Chemistry (Nov. 17, 2012), vol. 85, No. 2, pp. 427-435. (Year: 2012).*

Lyagaeva et al., "BaCe0.5Zr0.3Y0.2-xYbxO3-δ Proton-Conducting Electrolytes for Intermediate-Temperature Solid Oxide Fuel Cells ," Electrochimica Acta (Oct. 10, 2017), vol. 251, pp. 554-561. (Year: 2017).*

Yamazaki et al., "High Total Proton Conductivity in Large-Grained Yttrium-Doped Barium Zirconate", ChemMater, vol. 21, Issue 13, (May 2009), pp. 2755-2762.

Nahreen et al., "Catalytic Upgrading of Methane to Higher Hydrocarbon in a Nonoxidative Chemical Conversion", American Chemical Society, Energy & Fuels, vol. 30, (Mar. 2016) pp. 2584-2593.

Li et al., "BaZr0.1Ce0.7Y0.1Yb0.1O3—? as highly active and carbon tolerant anode for direct hydrocarbon solid oxide fuel cells", International Journal of Hydrogen Energy, vol. 39 (Jan. 2014) pp. 15975-15981.

Konwar et al., "A methane-fueled SOFC based on a thin BaZr0.1Ce0.7Y0.1Yb0.1O3- electrolyte film and a LaNi0.6Co0.4O3 anode functional layer", Journal of Materials Chemistry A, vol. 4, (Mar. 2016) pp. 5102-5106.

Kim et al., "Triple-Conducting Layered Perovskites as Cathode Materials for Proton-Conducting Solid Oxide Fuel Cells", ChemSusChem, vol. 7, Issue 10, (Aug. 2014), pp. 2811-2815.

Fu et al., "Ethane dehydrogenation over nano-Cr2O3 anode catalyst in proton ceramic fuel cell reactors to co-produce ethylene and electricity", Journal of Power Sources, vol. 196, Issue 3, (Aug. 2010), pp. 1036-1041.

Fabbri et al., "Design and fabrication of a chemically-stable proton conductor bilayer electrolyte for intermediate temperature solid oxide fuel cells (IT-SOFCs)", Energy & Environmental Science, vol. 1, (Jun. 2008), pp. 355-359.

International Search Report from International Application No. PCT/US2018/002615, dated Aug. 8, 2018, 4 pages.

International Written Opinion from International Application No. PCT/US2018/002615, dated Aug. 8, 2018, 8 pages.

Amar et al., "Solid-Slate Electrochemical Synthesis of Ammonia: A Review," Journal of Solid State Electrochemistry (Sep. 1, 2011), vol. 15, No. 9, pp. 1845-1860. (Year: 2011).

Fu et al., "CO2 Emission Free Co-Generation of Energy and Ethylene in Hydrocarbon SOFC Reactors with a Dehydrogenation Anode," Physical Chemistry Chemical Physics (2011), vol. 13, No. 43, pp. 19615-19623. (Year 2011).

Shi et al., "Protonic Membrane for Fuel Cell for Co-Generation of Power and Ethylene," Journal of Power Sources (Jan. 21, 2008), vol. 176, No. 1, pp. 122-127. (Year: 2008).

Souza et al., "Properties and Applications of Perovskite Proton Conductors," Materials Research (Sep. 2010), vol. 13, No. 3, pp. 385-394. (Year: 2010).

Chen et al., "Performance on PBI/H3P04 Proton Conducting membrane Fuel Cell Using Ethane as Fuel," Chinese Journal of Inorganic Chemistry (Jan. 2010), vol. 26, No. 1, pp. 132-137. (Year: 2010).

Feng et al., "Propane Dehydrogenation in a Proton-Conducting Fuel Cell," The Journal of Physical Chemistry C (Jul. 3, 2008), vol. 112, No. 26, pp. 9943-9949 (Year 2008).

Li et al., "Evaluation of Molybdenum Carbide as Anode Catalyst for Proton-Conducting Hydrogen and Ethane Solid Oxide Fuel Cells," Electrochemistry Communications (Feb. 1, 2012), vol. 15, No. 1, pp. 81-84 (Year 2012).

* cited by examiner

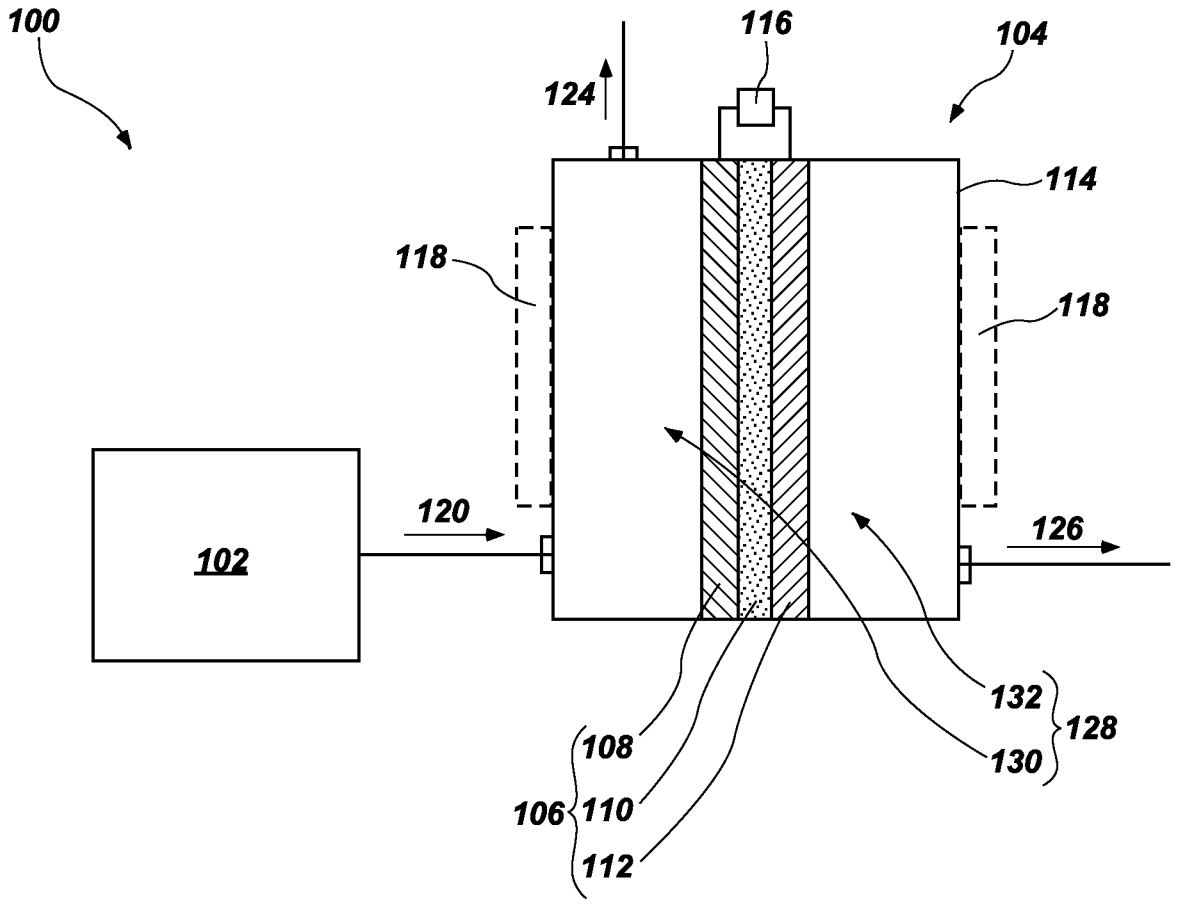
100
116
104
124
114
118
118
102
120
126
132
128
108
130
106
110
112

METHODS FOR PRODUCING HYDROCARBON PRODUCTS AND HYDROGEN GAS THROUGH ELECTROCHEMICAL ACTIVATION OF METHANE

CROSS-REFERENCE TO RELATED APPLICATION

This application claims the benefit under 35 U.S.C. § 119(e) of U.S. Provisional Patent Application Ser. No. 62/597,004, filed Dec. 11, 2017, the disclosure of which is hereby incorporated herein in its entirety by this reference.

STATEMENT REGARDING FEDERALLY SPONSORED RESEARCH OR DEVELOPMENT

This invention was made with government support under Contract Number DE-AC07-05ID14517 awarded by the United States Department of Energy. The government has certain rights in the invention.

TECHNICAL FIELD

The disclosure, in various embodiments, relates to methods, systems, and apparatuses for producing hydrocarbon products and hydrogen gas through electrochemical activation of methane.

BACKGROUND

Large reserves of natural gas continue to be discovered throughout the world, and have resulted in surpluses of methane ($CH_4$). $CH_4$ is predominantly formed into other hydrocarbon products such as ethylene ($C_2H_4$) through conventional stream cracking processes. However, conventional stream cracking of $CH_4$ can require high temperatures (e.g., temperatures greater than or equal to about 750° C.) to activate $CH_4$, resulting in undesirable energy expenditures (e.g., thermal energy expenditures) and/or environmental impacts (e.g., greenhouse gas emissions effectuated by the energy needs of the stream cracking processes). In addition, conventional stream cracking processes can require the use of complicated and costly systems and methods to purify (e.g., refine) the resulting hydrocarbon products.

It would be desirable to have new methods, systems, and apparatuses for synthesizing hydrocarbon products from $CH_4$. It would also be desirable if new methods, systems, and apparatuses facilitated the production of a variety of hydrocarbons, and also facilitated the production (e.g., co-production) and isolation of hydrogen gas. It would further be desirable if the new methods, systems, and apparatuses facilitated increased production efficiency, increased operational life, and were relatively inexpensive and simple in operation.

BRIEF SUMMARY

Embodiments described herein include methods, systems, and apparatuses for producing hydrocarbon products and hydrogen gas through electrochemical activation of $CH_4$. In accordance with one embodiment described herein, a method of forming a hydrocarbon product and hydrogen gas comprises introducing $CH_4$ to a positive electrode of an electrochemical cell comprising the positive electrode, a negative electrode, and a proton-conducting membrane between the positive electrode and the negative electrode.

The proton-conducting membrane comprises an electrolyte material having an ionic conductivity greater than or equal to about $10^{-2}$ S/cm at one or more temperatures within a range of from about 150° C. to about 600° C. A potential difference is applied between the positive electrode and the negative electrode of the electrochemical cell.

In additional embodiments, a $CH_4$ activation system comprises a source of $CH_4$ and an electrochemical apparatus in fluid communication with the source of $CH_4$. The electrochemical apparatus comprises a housing structure configured and positioned to receive a $CH_4$ stream from the source of $CH_4$, and an electrochemical cell within an internal chamber of the housing structure. The electrochemical cell comprises a positive electrode, a negative electrode, and a proton-conducting membrane between the positive electrode and the negative electrode. The positive electrode comprises a catalyst material formulated to accelerate reaction rates to produce $CH_3^+$, $H^+$, and $e^-$, from $CH_4$, and to accelerate reaction rates to synthesize at least one hydrocarbon product from the produced $CH_3^+$. The negative electrode comprises another catalyst material formulated to accelerate reaction rates to produce $H_{2(g)}$ from $H^+$ and $e^-$. The proton-conducting membrane comprises an electrolyte material having an ionic conductivity greater than or equal to about $10^{-2}$ S/cm at one or more temperatures within a range of from about 150° C. to about 600° C.

In further embodiments, an electrochemical cell comprises a positive electrode, a negative electrode, and a proton-conducting membrane between the positive electrode and the negative electrode. The positive electrode comprises a first catalyst material formulated to accelerate to $CH_4$ deprotonation reaction rates to produce $CH_3^+$, $H^+$, and $e^-$, from $CH_4$, and to accelerate coupling reaction rates to synthesize at least one hydrocarbon product from the produced $CH_3^+$. The negative electrode comprises a second catalyst material formulated to accelerate hydrogen evolution reaction rates to produce $H_{2(g)}$ from $H^+$ and $e^-$. The proton-conducting membrane comprises an electrolyte material having an ionic conductivity greater than or equal to about $10^{-2}$ S/cm at one or more temperatures within a range of from about 150° C. to about 600° C.

BRIEF DESCRIPTION OF THE DRAWING

FIG. 1 is a simplified schematic view of a hydrogen gas production system, in accordance with an embodiment of the disclosure.

DETAILED DESCRIPTION

Methods, systems, and apparatuses for producing (e.g., co-producing) hydrocarbon products and hydrogen gas ($H_{2(g)}$) through electrochemical activation of $CH_4$ are disclosed. In some embodiments, a method of producing hydrocarbon products and $H_{2(g)}$ includes directing $CH_4$ into an electrochemical apparatus including an electrochemical cell therein. The electrochemical cell comprises a positive electrode (anode), a negative electrode (cathode), and a proton-conducting membrane between the positive electrode and the negative electrode. The proton-conducting membrane includes an electrolyte material having an ionic conductivity greater than or equal to about $10^{-2}$ Siemens per centimeter (S/cm) at one or more temperatures within a range of from about 150° C. to about 600° C. The positive electrode includes a catalyst material formulated to accelerate $CH_4$ deprotonation reaction rates to produce $CH_3^+$, $H^+$, and $e^-$ from $CH_4$, and also formulated to accelerate coupling reaction rates (e.g., at least methyl coupling reaction rates) to synthesize one or more hydrocarbon products from the produced $CH_3^+$. The negative electrode comprises another catalyst material formulated to accelerate hydrogen evolution reaction rates to produce $H_{2(g)}$ from $H^+$ and $e^-$. Electrical current is applied to the $CH_4$ across the positive electrode and the negative electrode of the electrochemical cell at a temperature within the range of from about 150° C. to about 600° C. to produce at least one hydrocarbon product at the positive electrode and $H_{2(g)}$ at the negative electrode. The methods, systems, and apparatuses of the disclosure may be more efficient (e.g., increasing higher hydrocarbon and $H_{2(g)}$ production efficiency; reducing equipment, material, and/or energy requirements; etc.), more durable, and/or less complicated as compared to conventional methods, conventional systems, and conventional apparatuses for producing one or more of higher hydrocarbons and $H_{2(g)}$ from $CH_4$.

The following description provides specific details, such as material compositions and processing conditions (e.g., temperatures, pressures, flow rates, etc.) in order to provide a thorough description of embodiments of the disclosure. However, a person of ordinary skill in the art will understand that the embodiments of the disclosure may be practiced without necessarily employing these specific details. Indeed, the embodiments of the disclosure may be practiced in conjunction with conventional systems and methods employed in the industry. In addition, only those process components and acts necessary to understand the embodiments of the present disclosure are described in detail below. A person of ordinary skill in the art will understand that some process components (e.g., pipelines, line filters, valves, temperature detectors, flow detectors, pressure detectors, and the like) are inherently disclosed herein and that adding various conventional process components and acts would be in accord with the disclosure. In addition, the drawings accompanying the application are for illustrative purposes only, and are not meant to be actual views of any particular material, device, or system.

As used herein, the term "lower hydrocarbon" means and includes an aliphatic hydrocarbon having from one carbon atom to four carbon atoms (e.g., methane, ethane, ethylene, acetylene, propane, propylene, n-butane, isobutene, butane, isobutene, etc.).

As used herein, the terms "higher hydrocarbon" and "hydrocarbon product" mean and include an aliphatic or cyclic hydrocarbon having at least one more carbon atom than a lower hydrocarbon used to form the higher hydrocarbon.

As used herein, the term "cyclic hydrocarbon" means and includes at least one closed ring hydrocarbon, such as an alicyclic hydrocarbon, an aromatic hydrocarbon, or a combination thereof. The cyclic hydrocarbon may include only carbon and hydrogen, or may include carbon, hydrogen, and at least one heteroatom.

As used herein, the term "heteroatom" means and includes an element other than carbon and hydrogen, such as oxygen (O), nitrogen (N), or sulfur (S).

As used herein, the terms "catalyst material" and "catalyst" each mean and include a material formulated to promote one or more reactions, resulting in the formation of a product.

As used herein, the term "negative electrode" means and includes an electrode having a relatively lower electrode potential in an electrochemical cell (i.e., lower than the electrode potential in a positive electrode therein). Conversely, as used herein, the term "positive electrode" means and includes an electrode having a relatively higher electrode potential in an electrochemical cell (i.e., higher than the electrode potential in a negative electrode therein).

As used herein the term "electrolyte" means and includes an ionic conductor, which can be in a solid state, a liquid state, or a gas state (e.g., plasma).

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "below" or "beneath" or "under" or "on bottom of" other elements or features would then be oriented "above" or "on top of" the other elements or features. Thus, the term "below" can encompass both an orientation of above and below, depending on the context in which the term is used, which will be evident to one of ordinary skill in the art. The materials may be otherwise oriented (e.g., rotated 90 degrees, inverted, flipped) and the spatially relative descriptors used herein interpreted accordingly.

As used herein, the singular forms "a," "an," and "the" are intended to include the plural forms as well, unless the context clearly indicates otherwise.

As used herein, "and/or" includes any and all combinations of one or more of the associated listed items.

As used herein, the term "configured" refers to a size, shape, material composition, material distribution, and arrangement of one or more of at least one structure and at least one apparatus facilitating operation of one or more of the structure and the apparatus in a pre-determined way.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, at least 99.9% met, or even 100.0% met.

As used herein, the term "about" in reference to a given parameter is inclusive of the stated value and has the meaning dictated by the context (e.g., it includes the degree of error associated with measurement of the given parameter).

As used herein, the term "compatible" means that a material does not undesirably react, decompose, or absorb another material, and also that the material does not undesirably impair the chemical and/or mechanical properties of the another material.

An embodiment of the disclosure will now be described with reference to FIG. 1, which schematically illustrates a $CH_4$ activation system 100. The $CH_4$ activation system 100 may be used to convert $CH_4$ into at least one higher hydrocarbon and $H_{2(g)}$. As shown in FIG. 1, the $CH_4$ activation system 100 may include at least one $CH_4$ source 102 (e.g., containment vessel), and at least one electrochemical apparatus 104 in fluid communication with the $CH_4$ source 102. The electrochemical apparatus 104 includes a housing structure 114, and at least one electrochemical cell 106 contained within the housing structure 114. The electrochemical cell 106 is electrically connected (e.g., coupled) to a power source 116, and includes a positive electrode 108, a negative electrode 112, and a proton-conducting membrane 110 between the positive electrode 108 and the negative electrode 112. As shown in FIG. 1, optionally, the $CH_4$ activation system 100 may also include at least one heating apparatus 118 operatively associated with the electrochemical apparatus 104.

During use and operation, the $CH_4$ activation system 100 directs a $CH_4$ stream 120 into the electrochemical apparatus 104 to interact with the positive electrode 108 of the electrochemical cell 106. A potential difference (e.g., voltage) is applied between the positive electrode 108 and the negative electrode 112 of the electrochemical cell 106 by the power source 116 so that as the $CH_4$ interacts with the positive electrode 108, H atoms of the $CH_4$ release their electrons ($e^-$) to produce methyl radicals ($CH_3^+$), hydrogen ions ($H^+$) (i.e., protons), and electrons ($e^-$) through non-oxidative deprotonation according to the following equation:

$$CH_4 \rightarrow CH_3^+ + H^+ + e^- \quad (1).$$

The generated $H^+$ permeate (e.g., diffuse) across the proton-conducting membrane 110 to the negative electrode 112, and the generated $e^-$ are directed to the power source 116 through external circuitry. At the negative electrode 112, the generated $H^+$ exiting the proton-conducting membrane 110 react with $e^-$ received from the power source 116 to form H atoms that the combine to form $H_{2(g)}$ through a hydrogen evolution reaction, according to the following equation:

$$4H^+ + 4e^- \rightarrow 2H_{2(g)} \quad (2).$$

The $H_{2(g)}$ then exits the electrochemical apparatus 104 as a $H_{2(g)}$ stream 126. At the positive electrode 108, the produced $CH_3^+$ undergoes at least one methyl coupling reaction in the presence of a catalyst material of the positive electrode 108 to synthesize at least one higher hydrocarbon. By way of non-limiting example, two (2) produced $CH_3^+$ may react with one another to produce ethane ($C_2H_6$), which may then react with additional produced $CH_3^+$ to produce ethyl radicals ($C_2H_5^+$) according to the following equations:

$$2CH_3^+ \rightarrow C_2H_6 \quad (3).$$

$$C_2H_6 \rightarrow C_2H_5^+ + CH_4 \quad (4).$$

The $C_2H_5^+$ may then be deprotonated to produce ethylene ($C_2H_4$) according to the following equation:

$$C_2H_5^+ \rightarrow C_2H_4 + H^+ \quad (5).$$

In addition, at least partially depending on the conditions (e.g., catalyst material(s), temperatures, pressures) at the positive electrode 108, the produced $C_2H_4$ may undergo at least one ethyl coupling reaction to synthesize at least one other hydrocarbon product, according to the following equation:

$$nC_2H_4 \rightarrow C_{2n}H_{4n} \quad (6).$$

The hydrocarbon product exits the electrochemical apparatus 104 as a hydrocarbon product stream 124.

As described in further detail below, the hydrocarbon products synthesized at the positive electrode 108 and the production of $H_{2(g)}$ at the negative electrode 112 may at least partially depend on the material composition and flow rate of the $CH_4$ stream 120; the configuration (e.g., size, shape, material composition, material distribution, arrangement) of the positive electrode 108, including the types, quantities, distribution, and properties (e.g., geometric properties, thermodynamic properties, etc.) of catalyst materials thereof promoting $CH_4$ deprotonation reactions and coupling reactions (e.g., methyl coupling reactions, ethyl coupling reactions (if any)); the configuration of the proton-conducting membrane 110, and the impact thereof on the diffusivity (e.g., diffusion rate) of generated $H^+$ therethrough; the configuration of the negative electrode, including the types, quantities, and properties (e.g., geometric properties, thermodynamic properties, etc.) of catalyst materials thereof promoting hydrogen evolution reactions; and the operational parameters (e.g., temperatures, pressures, etc.) of the electrochemical apparatus 104. Such operational factors may be controlled (e.g., adjusted, maintained, etc.) as desired to control the types, quantities, and rate of production of the hydrocarbon product(s) synthesized at the positive electrode 108 and to control the quantity and rate of production of the $H_{2(g)}$ produced at the negative electrode 112. In some embodiments, the hydrocarbon product(s) exiting the electrochemical apparatus 104 in the hydrocarbon product stream 124 may be examined (e.g., through in-line gas chromatography-mass spectrometry (GS-MS)) and compared to a mathematically modeled Anderson-Schulz-Flory distribution to analyze whether or not sufficient coupling reactions are occurring at the positive electrode 108 for the synthesis of one or more desired higher hydrocarbons. One or more operational factors of the $CH_4$ activation system 100 (e.g., one or more of the type, quantity, and distribution of catalyst material(s) in the positive electrode 108, the operating temperature of the electrochemical apparatus 104, etc.) may be adjusted or maintained based on the results of the analysis. Accordingly, the operational factors of the $CH_4$ activation system 100 may be tailored to facilitate the production of $H_{2(g)}$ and one or more specific higher hydrocarbons from the components (e.g., $CH_4$) of the $CH_4$ stream 120.

The $CH_4$ stream 120 may be formed of and include $CH_4$. In addition, the $CH_4$ stream 120 may, optionally, include one or more other materials (e.g., molecules), such as one or more other lower hydrocarbons (e.g., one or more $C_2$ to $C_4$ hydrocarbons, such as one or more of $C_2H_6$, propane ($C_3H_8$), and butane ($C_4H_{10}$)) that may undergo a chemical reaction in the presence of the positive electrode 108 of the electrochemical cell 106 to produce at least one higher hydrocarbon, and/or one or more other materials (e.g., $H_2$, nitrogen ($N_2$), etc.). In some embodiments, the $CH_4$ stream 120 is substantially free of materials other than $CH_4$. In additional embodiments, the $CH_4$ stream 120 includes $CH_4$ and $C_2H_6$. The $CH_4$ stream 120 may be substantially gaseous (e.g., may only include a single gaseous phase), may be substantially liquid (e.g., may only include a single liquid phase), or may include a combination of liquid and gaseous phases. The phase(s) of the $CH_4$ stream 120 (and, hence, a temperature and a pressure of the $CH_4$ stream 120) may at least partially depend on the operating temperature of the electrochemical cell 106 of the electrochemical apparatus 104. In some embodiments, the $CH_4$ stream 120 is substantially gaseous.

A single (e.g., only one) $CH_4$ stream 120 may be directed into the electrochemical apparatus 104 from the $CH_4$ source 102, or multiple (e.g., more than one) $CH_4$ streams 120 may be directed into the electrochemical apparatus 104 from the $CH_4$ source 102. If multiple $CH_4$ streams 120 are directed into the electrochemical apparatus 104, each of the multiple $CH_4$ streams 120 may exhibit substantially the same properties (e.g., substantially the same material composition, substantially the same temperature, substantially the same pressure, substantially the same flow rate, etc.), or at least one of the multiple $CH_4$ streams 120 may exhibit one or more different properties (e.g., a different material composition, a different temperature, a different pressure, a different flow rate, etc.) than at least one other of the multiple $CH_4$ streams 120.

The heating apparatus 118, if present, may comprise at least one apparatus (e.g., one or more of a combustion heater, an electrical resistance heater, an inductive heater, and an electromagnetic heater) configured and operated to heat one or more of the $CH_4$ stream 120, and at least a portion of the electrochemical apparatus 104 to an operating temperature of the electrochemical apparatus 104. The operating temperature of the electrochemical apparatus 104 may at least partially depend on a material composition of the proton-conducting membrane 110 of the electrochemical cell 106 thereof, as described in further detail below. In some embodiments, the heating apparatus 118 heats one or more of the $CH_4$ stream 120, and at least a portion of the electrochemical apparatus 104 to a temperature within a range of from about 150° C. to about 600° C. In additional embodiments, such as in embodiments wherein a temperature of the $CH_4$ stream 120 is already within the operating temperature range of the electrochemical cell 106 of the electrochemical apparatus 104, the heating apparatus 118 may be omitted (e.g., absent) from the $CH_4$ activation system 100.

With continued reference to FIG. 1, the electrochemical apparatus 104, including the housing structure 114 and the electrochemical cell 106 thereof, is configured and operated to form the hydrocarbon product stream 124 and the $H_{2(g)}$ stream 126 from the $CH_4$ stream 120. The housing structure 114 may exhibit any shape (e.g., a tubular shape, a quadrilateral shape, a spherical shape, a semi-spherical shape, a cylindrical shape, a semi-cylindrical shape, truncated versions thereof, or an irregular shape) and size able to contain (e.g., hold) the electrochemical cell 106 therein, to receive and direct the $CH_4$ stream 120 to the positive electrode 108 of the electrochemical cell 106, to direct the high hydrocarbon product(s) synthesized at the positive electrode 108 away from the electrochemical apparatus as the hydrocarbon product stream 124, and to direct the $H_{2(g)}$ formed at the negative electrode 112 of the electrochemical cell 106 away from the electrochemical apparatus 104 as the $H_{2(g)}$ stream 126. In addition, the housing structure 114 may be formed of and include any material (e.g., glass, metal, alloy, polymer, ceramic, composite, combination thereof, etc.) compatible with the operating conditions (e.g., temperatures, pressures, etc.) of the electrochemical apparatus 104.

The housing structure 114 may at least partially define at least one internal chamber 128 at least partially surrounding the electrochemical cell 106. The electrochemical cell 106 may serve as a boundary between a first region 130 (e.g., an anodic region) of the internal chamber 128 configured and positioned to receive the $CH_4$ stream 120 and to direct the hydrocarbon product stream 124 from the electrochemical apparatus 104, and a second region 132 (e.g., a cathodic region) of the internal chamber 128 configured and positioned to receive the $H_{2(g)}$ produced at the positive electrode 108 of the electrochemical cell 106. Molecules (e.g., $CH_4$) of the $CH_4$ stream 120 may be substantially limited to the first region 130 of the internal chamber 128 by the configurations and positions of the housing structure 114 and the electrochemical cell 106. Keeping the second region 132 of the internal chamber 128 substantially free of molecules from the $CH_4$ stream 120 circumvents additional processing of the produced $H_{2(g)}$ (e.g., to separate the produced $H_{2(g)}$ from $CH_4$) that may otherwise be necessary if the components of the $CH_4$ stream 120 were also delivered to within the second region 132 of the internal chamber 128.

As shown in FIG. 1, the positive electrode 108 and the negative electrode 112 of the electrochemical cell 106 are electrically coupled to a power source 116, and the proton-conducting membrane 110 is disposed on and between the positive electrode 108 and the negative electrode 112. The proton-conducting membrane 110 is configured and formulated to conduct $H^+$ from the positive electrode 108 to the negative electrode 112, while electrically insulating the negative electrode 112 from the positive electrode 108 and preventing the migration of molecules (e.g., $CH_4$, $CH_3^+$, higher hydrocarbons) therethrough. Electrons generated at the positive electrode 108 through the reaction of Equation (1) described above may, for example, flow from the positive electrode 108 into a negative current collector, through the power source 116 and a positive electrode current collector, and into negative electrode 112 to facilitate the production of $H_{2(g)}$ through the reaction of Equation (2) described above.

The proton-conducting membrane 110 may be formed of and include at least one electrolyte material exhibiting an ionic conductivity (e.g., $H^+$ conductivity) greater than or equal to about $10^{-2}$ S/cm (e.g., within a range of from about $10^{-2}$ S/cm to about 1 S/cm) at one or more temperatures within a range of from about 150° C. to about 600° C. (e.g., from about 200° C. to about 600° C.). In addition, the electrolyte material may be formulated to remain substantially adhered (e.g., laminated) to the positive electrode 108 and the negative electrode 112 at relatively high current densities, such as at current densities greater than or equal to about 0.1 amperes per square centimeter ($A/cm^2$) (e.g., greater than or equal to about 0.5 $A/cm^2$, greater than or equal to about 1.0 $A/cm^2$, greater than or equal to about 2.0 $A/cm^2$, etc.). For example, the proton-conducting membrane 110 may comprise one or more of a perovskite material, a solid acid material, and a polybenzimidazole (PBI) material. The material composition of the proton-conducting membrane 110 may provide the proton-conducting membrane 110 with enhanced ionic conductivity at a temperature within the range of from about 150° C. to about 600° C. as compared to conventional membranes (e.g., membranes employing conventional electrolyte materials, such as yttria-stabilized zirconia (YSZ)) of conventional electrochemical cells. By way of non-limiting example, the electrolyte material (e.g., perovskite material, solid acid material, PBI material) of the proton-conducting membrane 110 may have orders of magnitude higher ionic conductivity than YSZ at operational temperatures thereof within the range of from about 150° C. to about 600° C.

In some embodiments, the proton-conducting membrane 110 is formed of and includes at least one perovskite material having an operational temperature (e.g., a temperature at which the $H^+$ conductivity of the perovskite material is greater than or equal to about $10^{-2}$ S/cm, such as within a range of from about $10^{-2}$ S/cm to about $10^{-1}$ S/cm) within a range of from about 400° C. to about 600° C. By way of non-limiting example, the proton-conducting membrane 110 may comprise one or more of a yttrium- and ytterbium-doped barium-zirconate-cerate (BZCYYb), such as $BaZr_{0.8-y}Ce_yY_{0.2-x}Yb_xO_{3-\delta}$, wherein x and y are dopant levels and δ is the oxygen deficit (e.g., $BaZr_{0.3}Ce_{0.5}Y_{0.1}Yb_{0.1}O_{3-\delta}$); a yttrium- and ytterbium-doped barium-strontium-niobate (BSNYYb), such as $Ba_3(Sr_{1-x}Nb_{2-y}Y_xYb_y)O_{9-\delta}$, wherein x and y are dopant levels and δ is the oxygen deficit; doped barium-cerate ($BaCeO_3$) (e.g., yttrium-doped $BaCeO_3$ (BCY)); doped barium-zirconate ($BaZrO_3$) (e.g., yttrium-doped $BaCeO_3$ (BZY)); bariumyttrium-stannate ($Ba_2(YSn)O_{5.5}$); and barium-calcium-niobate ($Ba_3(CaNb_2)O_9$). In some embodiments, the proton-conducting membrane 110 comprises BZCYYb.

In further embodiments, the proton-conducting membrane 110 is formed of and includes at least one solid acid material having an operational temperature (e.g., a temperature at which the $H^+$ conductivity of the solid acid material is greater than or equal to about $10^{-2}$ S/cm, such as within a range of from about $10^{-2}$ S/cm to about 1 S/cm) within a range of from about 200° C. to about 400° C. By way of non-limiting example, the proton-conducting membrane 110 may comprise a solid acid phosphate material, such as solid acid cesium dihydrogen phosphate ($CsH_2PO_4$). The solid acid material may be doped (e.g., doped $CsH_2PO_4$), or may be undoped (e.g., undoped $CsH_2PO_4$). In some embodiments, the proton-conducting membrane 110 comprises $CsH_2PO_4$.

In additional embodiments, the proton-conducting membrane 110 is formed of and includes at least one PBI material having an operational temperature (e.g., a temperature at which the $H^+$ conductivity of the PBI material is greater than or equal to about $10^{-2}$ S/cm, such as within a range of from about $10^{-2}$ S/cm to about 1 S/cm) within a range of from about 150° C. to about 250° C. By way of non-limiting example, the proton-conducting membrane 110 may comprise a doped PBI, such as phosphoric acid ($H_3PO_4$) doped PBI. In some embodiments, the proton-conducting membrane 110 comprises $H_3PO_4$-doped PBI.

The proton-conducting membrane 110 may be substantially homogeneous or may be substantially heterogeneous. As used herein, the term "homogeneous" means amounts of a material do not vary throughout different portions (e.g., different lateral and longitudinal portions) of a structure. Conversely, as used herein, the term "heterogeneous" means amounts of a material vary throughout different portions of a structure. Amounts of the material may vary stepwise (e.g., change abruptly), or may vary continuously (e.g., change progressively, such as linearly, parabolically) throughout different portions of the structure. In some embodiments, the proton-conducting membrane 110 is substantially homogeneous. In additional embodiments, the proton-conducting membrane 110 is heterogeneous. The proton-conducting membrane 110 may, for example, be formed of and include a stack of at least two (e.g., at least three, at least four, etc.) different materials. As a non-limiting example, the proton-conducting membrane 110 may comprise a stack of at least two (e.g., at least three, at least four, etc.) different perovskite materials individually having an operational temperature within a range of from about 400° C. to about 600° C. As another non-limiting example, the proton-conducting membrane 110 may comprise a stack of at least two (e.g., at least three, at least four, etc.) different solid acid materials individually having an operational temperature within a range of from about 200° C. to about 400° C. As a further non-limiting example, the proton-conducting membrane 110 may comprise a stack of at least two (e.g., at least three, at least four, etc.) different PBI materials individually having an operational temperature within a range of from about 150° C. to about 250° C.

The proton-conducting membrane 110 may exhibit any desired dimensions (e.g., length, width, thickness) and any desired shape (e.g., a cubic shape, cuboidal shape, a tubular shape, a tubular spiral shape, a spherical shape, a semi-spherical shape, a cylindrical shape, a semi-cylindrical shape, a conical shape, a triangular prismatic shape, a truncated version of one or more of the foregoing, and irregular shape). The dimensions and the shape of the proton-conducting membrane 110 may be selected such that the proton-conducting membrane 110 substantially intervenes between opposing surfaces of the positive electrode 108 and the negative electrode 112, and exhibits an $H^+$ conductivity greater than or equal to about $10^{-2}$ S/cm (e.g., from about $10^{-2}$ S/cm to about 1 S/cm) at a temperature within a range of from about 150° C. to about 600° C. A thickness of the proton-conducting membrane 110 may be within a range of from about 5 micrometers (μm) to about 1000 μm, and may at least partially depend on the material composition of the proton-conducting membrane 110. For example, a proton-conducting membrane 110 formed of and including at least one perovskite material may have a thickness with a range of from about 5 μm to about 1000 μm; a proton-conducting membrane 110 formed of and including at least one solid acid material may have a thickness with a range of from about 5 μm to about 1000 μm; and a proton-conducting membrane 110 formed of and including at least one PBI material may have a thickness with a range of from about 50 μm to about 1000 μm.

The positive electrode 108 and the negative electrode 112 may individually be formed of and include at least one catalyst-doped material compatible with the material composition of the proton-conducting membrane 110 and the operating conditions (e.g., temperature, pressure, current density, etc.) of the electrochemical cell 106, and facilitating the formation of the hydrocarbon product stream 124 and the $H_{2(g)}$ stream 126 from the $CH_4$ stream 120 at an operational temperature within the range of from about 150° C. to about 600° C. Accordingly, the material compositions of the positive electrode 108 and the negative electrode 112 may be selected relative to one another, the material composition of the proton-conducting membrane 110, the material composition of the $CH_4$ stream 120, and the operating conditions of the electrochemical cell 106.

The catalyst-doped material of the positive electrode 108 includes at least one catalyst material thereon, thereover, and/or therein that accelerates reaction rates at the positive electrode 108 to produce $CH_3^+$, $H^+$, and $e^-$ from $CH_4$ in accordance with Equation (1) above, and that also accelerates reaction rates at the positive electrode 108 to synthesize one or more higher hydrocarbons from the produced $CH_3^+$ (e.g., in accordance with one or more of Equations (3) through (6) above). The catalyst material may, for example, comprise a metallic material formulated to accelerate reaction rates at the positive electrode 108 to produce $CH_3^+$, $H^+$, and $e^-$ from $CH_4$, and to accelerate reaction rates for the synthesis of higher hydrocarbons from the produced $CH_3^+$. In some embodiments, the catalyst material comprises elemental particles of a first metal formulated to accelerate reaction rates at the positive electrode 108 to produce $CH_3^+$, $H^+$, and $e^-$ from $CH_4$, and additional elemental particles of a second metal discrete from the elemental particles of the first metal and formulated to accelerate reaction rates for the synthesis of higher hydrocarbons from the produced $CH_3^+$. In additional embodiments, the catalyst material comprises alloy particles individually including an alloy comprising the first metal and the second metal. In further embodiments, the catalyst material comprises composite particles including one of the first metal and the second metal partially (e.g., less than completely) coating (e.g., covering, encapsulating) the other of the first metal and the second metal, such as composite particles individually including a shell of the second metal partially coating a core of the first metal, and/or composite particles individually including a shell of the first metal partially coating a core of the second metal. In yet further embodiments, the catalyst material comprises composite particles including an alloy including one of the first metal and the second metal partially coating the another alloy including the other of the first metal and the second metal, such as composite particles individually including a shell of an alloy including the second metal partially coating a core of another alloy including the first metal, and/or composite particles individually including a shell of an alloy including the first metal partially coating a core of another alloy including the second metal. In still further embodiments, the catalyst material comprises composite particles including one of the first metal and the second metal partially coating an alloy including the other of the first metal and the second metal, such as composite particles individually including a shell of the second metal partially coating a core of an alloy including the first metal, and/or composite particles individually including a shell of the first metal partially coating a core of an alloy including the second metal. In yet still further embodiments, the catalyst material comprises composite particles including an alloy including one of the first metal and the second metal partially coating the other of the first metal and the second metal, such as composite particles individually including a shell of an alloy including the second metal partially coating a core of the first metal, and/or composite particles individually including a shell of an alloy including the first metal partially coating a core of the second metal.

Particles (e.g., elemental particles, alloy particles, composite particles) of the catalyst material of the catalyst-doped material of the positive electrode 108 may be nano-sized (e.g., individually having a cross-sectional width or diameter less than about one (1) μm, such as less than or equal to about 100 nanometers (nm), less than or equal to about 20 nm, or less than or equal to about 10 nm). In addition, the catalyst-doped material of the positive electrode 108 may exhibit any amount (e.g., concentration) and distribution of the catalyst material and any ratio of components thereof (e.g., any ratio of a first metal formulated to accelerate reaction rates at the positive electrode 108 to produce $CH_3^+$, $H^+$, and $e^-$ from $CH_4$ to a second metal formulated to accelerate reaction rates for the synthesis of higher hydrocarbons from the produced $CH_3^+$) facilitating desired $CH_4$ deprotonation reaction rates and desired coupling reaction rates (e.g., methyl coupling reaction rates, ethyl coupling reaction rates (if any), etc.) at the positive electrode 108.

The catalyst-doped material of the negative electrode 112 includes least one catalyst material thereon, thereover, and/or therein that accelerates reaction rates at the negative electrode 112 to produce $H_{2(g)}$ from $H^+$ and $e^-$ in accordance with Equation (2) above. The catalyst material may, for example, comprise a metallic material including at least one metal, such as one or more of Ni and platinum (Pt), formulated to accelerate reaction rates at the negative electrode 112 to produce $H_{2(g)}$ from $H^+$ and $e^-$ in accordance with Equation (2) above. The catalyst material of the catalyst-doped material of the negative electrode 112 may comprise nano-sized particles (e.g., nano-sized elemental particles, nano-sized alloy particles, and/or nano-sized composite particles). The catalyst-doped material of the negative electrode 112 may exhibit any amount (e.g., concentration) and distribution of the catalyst material any ratio of components thereof facilitating desired hydrogen evolution reaction (HER) rates at the negative electrode 112.

By way of non-limiting example, if the proton-conducting membrane 110 comprises a perovskite material (e.g., a BZCYYb, a BSNYYb, a doped $BaCeO_3$, a doped $BaZrO_3$, $Ba_2(YSn)O_{5.5}$, $Ba_3(CaNb_2)O_9$, etc.) having an operational temperature within a range of from about 400° C. to about 600° C., the positive electrode 108 may comprise one or more of (e.g., two or more of, three or more of) ruthenium (Ru), rhodium (Rh), nickel (Ni), iridium (Ir), molybdenum (Mo), zinc (Zn), and iron (Fe); and the negative electrode 112 may comprise a catalyst-doped perovskite material. The positive electrode 108 may, for example, comprise a catalyst-doped material including elemental particles individually including Ru, Rh, Ni, Ir, Mo, Zn, or Fe; alloy particles individually including one or more of Ru, Rh, Ni, Ir, Mo, Zn, and Fe; composite particles (e.g., core/shell particles) individually including silicon dioxide ($SiO_2$) and one or more of Ru, Rh, Ni, Ir, Mo, Zn, and Fe, such as composite particles of Fe and $SiO_2$ (Fe@$SiO_2$) and/or composite particles of Mo and $SiO_2$ (Mo@$SiO_2$); composite particles individually including silicon carbide (SiC) and one or more of Ru, Rh, Ni, Ir, Mo, Zn, and Fe, such as composite particles of Fe and SiC (Fe@SiC) and/or composite particles of Mo and SiC (Mo@SiC); aluminosilicate zeolite (e.g., Zeolite Socony Mobil-5 (ZSM-5), Hollow Zeolite Socony Mobil-5 (HZSM-5)) structures embedded with one or more of Ru, Rh, Ni, Ir, Mo, Zn, and Fe, such as Fe/HZ SM-5 and/or Mo/HZSM-5; particles individually including a carbide of one or more of Ru, Rh, Ni, Ir, Mo, Zn, and Fe, such as molybdenum carbide ($Mo_2C$); and/or particles individually including a multi-metallic compound (e.g., a bimetallic compound, a trimetallic compound) comprising two or more (e.g., two, three, more than three) of Ru, Rh, Ni, Ir, Mo, Zn, and Fe. In addition, the negative electrode 112 may, for example, comprise a cermet material comprising at least one catalyst material including Ni, and at least one perovskite, such as a Ni/perovskite cermet (Ni-perovskite) material (e.g., Ni—BZCYYb, Ni—BSNYYb, Ni—$BaCeO_3$, Ni—$BaZrO_3$, Ni—$Ba_2(YSn)O_{5.5}$, Ni—$Ba_3(CaNb_2)O_9$). In some embodiments, the proton-conducting membrane 110 comprises BZCYYb, the positive electrode 108 comprises Fe@$SiO_2$, and the negative electrode 112 comprises Ni—BZCYYb. In additional embodiments, the proton-conducting membrane 110 comprises BZCYYb, the positive electrode 108 comprises $Mo_2C$, and the negative electrode 112 comprises Ni—BZCYYb.

As another non-limiting example, if the proton-conducting membrane 110 comprises a solid acid material (e.g., a doped $CsH_2PO_4$, an undoped $CsH_2PO_4$) having an operational temperature within a range of from about 200° C. to about 400° C., the positive electrode 108 may comprise one or more of Ni, and a metallic material (e.g., an alloy, a bimetallic compound) including Ru and cobalt (Co); and the negative electrode 112 may comprise a cermet material comprising at least one catalyst material including Pt and at least one solid acid. The positive electrode 108 may, for example, comprise Ni; and/or a Ru—Co bimetallic compound. In addition, the negative electrode 112 may, for example, comprise a cermet material comprising Pt and $CsH_2PO_4$ (Pt—$CsH_2PO_4$ cermet). In some embodiments, the positive electrode 108 comprises Ni, and the negative electrode 112 comprises Pt—$CsH_2PO_4$ cermet. In additional embodiments, the positive electrode 108 comprises a Ru—Co bimetallic compound, and the negative electrode 112 comprises Pt—$CsH_2PO_4$ cermet.

As a further non-limiting example, if the proton-conducting membrane 110 comprises a PBI material (e.g., a doped PBI) having an operational temperature within a range of from about 150° C. to about 250° C., the positive electrode 108 may comprise a metallic material (e.g., an alloy, a bimetallic compound, a trimetallic compound) including two or more of Pd, Co, and platinum (Pt), and the negative electrode 112 may comprise one or more of Ni and Pt. The positive electrode 108 may, for example, comprise an alloy of Pd and one of more of Pt and Co (e.g., a Pd—Co alloy, a Pd—Pt alloy, a Pd—Pt—Co alloy); a bimetallic compound comprising Pd and one of Co and Pt; and/or a trimetallic compound including Pd, Pt, and Co. In addition, the negative electrode 112 may, for example, comprise one or more of elemental (e.g., non-alloyed, non-compounded) Ni, elemental Pt, a Ni alloy, and a Pt alloy. In some embodiments, the positive electrode 108 comprises a Pd—Co bimetallic compound, and the negative electrode 112 comprises one or more of Ni and Pt. In additional embodiments, the positive electrode 108 comprises a Pd—Pt bimetallic compound, and the negative electrode 112 comprises one or more of Ni and P. In further embodiments, the positive electrode 108 comprises a Pd—Pt—Co trimetallic compound, and the negative electrode 112 comprises one or more of Ni and P.

The positive electrode 108 and the negative electrode 112 may individually exhibit any desired dimensions (e.g., length, width, thickness) and any desired shape (e.g., a cubic shape, cuboidal shape, a tubular shape, a tubular spiral shape, a spherical shape, a semi-spherical shape, a cylindrical shape, a semi-cylindrical shape, a conical shape, a triangular prismatic shape, a truncated version of one or more of the foregoing, and irregular shape). The dimensions and the shapes of the positive electrode 108 and the negative electrode 112 may be selected relative to the dimensions and the shape of the proton-conducting membrane 110 such that the proton-conducting membrane 110 substantially intervenes between opposing surfaces of the positive electrode 108 and the negative electrode 112. Thicknesses of the positive electrode 108 and the negative electrode 112 may individually be within a range of from about 10 μm to about 1000 μm.

The electrochemical cell 106, including the positive electrode 108, the proton-conducting membrane 110, and the negative electrode 112 thereof, may be formed through conventional processes (e.g., rolling process, milling processes, shaping processes, pressing processes, consolidation processes, etc.), which are not described in detail herein. The electrochemical cell 106 may be mono-faced or bi-faced and may have a prismatic, folded, wound, cylindrical, or jelly rolled configuration. The electrochemical cell 106 may be placed within the housing structure 114 to form the electrochemical apparatus 104, and may be electrically connected to the power source 116.

Although the electrochemical apparatus 104 is depicted as including a single (i.e., only one) electrochemical cell 106 in FIG. 1, the electrochemical apparatus 104 may include any number of electrochemical cells 106. Put another way, the electrochemical apparatus 104 may include a single (e.g., only one) electrochemical cell 106, or may include multiple (e.g., more than one) electrochemical cells 106. If the electrochemical apparatus 104 includes multiple electrochemical cells 106, each of the electrochemical cells 106 may be substantially the same (e.g., exhibit substantially the same components, component sizes, component shapes, component material compositions, component material distributions, component positions, component orientations, etc.) and may be operated under substantially the same conditions (e.g., substantially the same temperatures, pressures, flow rates, etc.), or at least one of the electrochemical cells 106 may be different (e.g., exhibit one or more of different components, different component sizes, different component shapes, different component material compositions, different component material distributions, different component positions, different component orientations, etc.) than at least one other of the electrochemical cells 106 and/or may be operated under different conditions (e.g., different temperatures, different pressures, different flow rates, etc.) than at least one other of the electrochemical cells 106. By way of non-limiting example, one of the electrochemical cells 106 may be configured for and operated under a different temperature (e.g., different operating temperature resulting from a different material composition of one of more components thereof, such as a different material composition of the proton-conducting membrane 110 thereof) than at least one other of the electrochemical cells 106. In some embodiments, two of more electrochemical cells 106 are provided in parallel with one another within the housing structure 114 of the electrochemical apparatus 104, and individually produce a portion of the hydrocarbon product(s) directed out of the electrochemical apparatus 104 as the hydrocarbon product stream 124 and a portion of the $H_{2(g)}$ directed out of the electrochemical apparatus 104 as the $H_{2(g)}$ stream 126.

In addition, although the $CH_4$ activation system 100 is depicted as including a single (i.e., only one) electrochemical apparatus 104 in FIG. 1, the $CH_4$ activation system 100 may include any number of electrochemical apparatuses 104. Put another way, the $CH_4$ activation system 100 may include a single (e.g., only one) electrochemical apparatus 104, or may include multiple (e.g., more than one) electrochemical apparatuses 104. If the $CH_4$ activation system 100 includes multiple electrochemical apparatuses 104, each of the electrochemical apparatuses 104 may be substantially the same (e.g., exhibit substantially the same components, component sizes, component shapes, component material compositions, component material distributions, component positions, component orientations, etc.) and may be operated under substantially the same conditions (e.g., substantially the same temperatures, pressures, flow rates, etc.), or at least one of the electrochemical apparatus 104 may be different (e.g., exhibit one or more of different components, different component sizes, different component shapes, different component material compositions, different component material distributions, different component positions, different component orientations, etc.) than at least one other of the electrochemical apparatuses 104 and/or may be operated under different conditions (e.g., different temperatures, different pressures, different flow rates, etc.) than at least one other of the electrochemical apparatuses 104. By way of non-limiting example, one of the electrochemical apparatuses 104 may be configured for and operated under a different temperature (e.g., a different operating temperature resulting from a different material composition of one of more components of an electrochemical cell 106 thereof, such as a different material composition of the proton-conducting membrane 110 thereof) than at least one other of the electrochemical apparatuses 104. In some embodiments, two of more electrochemical apparatuses 104 are provided in parallel with one another. Each of the two of more electrochemical apparatuses 104 may individually receive a $CH_4$ stream 120 and may individually form a hydrocarbon product stream 124 and a $H_{2(g)}$ stream 126.

Still referring to FIG. 1, the hydrocarbon product stream 124 and the $H_{2(g)}$ stream 126 exiting the electrochemical apparatus 104 may individually be utilized or disposed of as desired. In some embodiments, the hydrocarbon product stream 124 and the $H_{2(g)}$ stream 126 are individually delivered into one or more storage vessels for subsequent use, as desired. In additional embodiments, at least a portion of one or more of the hydrocarbon product stream 124 and the $H_{2(g)}$ stream 126 may be utilized (e.g., combusted) to heat one or more components (e.g., the heating apparatus 118 (if present); the electrochemical apparatus 104; etc.) and/or streams (e.g., the $CH_4$ stream 120) of the $CH_4$ activation system 100. By way of non-limiting example, as shown in FIG. 1, if the heating apparatus 118 (if present) is a combustion-based apparatus, at least a portion of one or more of the hydrocarbon product stream 124 and the $H_{2(g)}$ stream 126 may be directed into the heating apparatus 118 and undergo an combustion reaction to efficiently heat one or more of the $CH_4$ stream 120 entering the electrochemical apparatus 104 and at least a portion of the electrochemical apparatus 104. Utilizing the hydrocarbon product stream 124 and/or the $H_{2(g)}$ stream 126 as described above may reduce the electrical power requirements of the $CH_4$ activation system 100 by enabling the utilization of direct thermal energy.

Thermal energy input into (e.g., through the heating apparatus 118 (if present)) and/or generated by the electrochemical apparatus 104 may also be used to heat one or more other components and/or streams (e.g., the $CH_4$ stream 120) of the $CH_4$ activation system 100. By way of non-limiting example, the hydrocarbon product stream 124 and/or the $H_{2(g)}$ stream 126 exiting the electrochemical apparatus 104 may be directed into a heat exchanger configured and operated to facilitate heat exchange between the hydrocarbon product stream 124 and/or the $H_{2(g)}$ stream 126 of the $CH_4$ activation system 100 and one or more other relatively cooler streams (e.g., the $CH_4$ stream 120) of the $CH_4$ activation system 100 to transfer heat from the hydrocarbon product stream 124 and/or the $H_{2(g)}$ stream 126 to the relatively cooler stream(s) to facilitate the recovery of the thermal energy input into and generated within the electrochemical apparatus 104. The recovered thermal energy may increase process efficiency and/or reduce operational costs without having to react (e.g., combust) higher hydrocarbon products of the hydrocarbon product stream 124 and/or $H_{2(g)}$ of the $H_{2(g)}$ stream 126.

The methods, systems (e.g., the $CH_4$ activation system 100), and apparatuses (e.g., the electrochemical apparatus 104, including the electrochemical cell 106 thereof) of the disclosure facilitate the simple and efficient co-production of higher hydrocarbons (e.g., butylene, gasoline, diesel, etc.) and $H_{2(g)}$ from $CH_4$ at intermediate temperatures, such as temperatures within a range of from about 150° C. to about 600° C. The methods, systems, and apparatuses of the disclosure may reduce one or more of the time (e.g., processing steps), costs (e.g., material costs), and energy (e.g., thermal energy, electrical energy, etc.) required to produce higher hydrocarbons from $CH_4$ relative to conventional methods, systems, and apparatuses of producing higher hydrocarbons from $CH_4$. The methods, systems, and apparatuses of the disclosure may be more efficient, durable, and reliable that conventional methods, conventional systems, and conventional apparatuses of producing higher hydrocarbons and $H_{2(g)}$.

While the disclosure is susceptible to various modifications and alternative forms, specific embodiments have been shown by way of example in the drawings and have been described in detail herein. However, the disclosure is not limited to the particular forms disclosed. Rather, the disclosure is to cover all modifications, equivalents, and alternatives falling within the scope of the following appended claims and their legal equivalent. For example, elements and features disclosed in relation to one embodiment may be combined with elements and features disclosed in relation to other embodiments of the disclosure.

What is claimed is:

1. A method of forming a hydrocarbon product and hydrogen gas, comprising:

introducing methane ($CH_4$) to a positive electrode of an electrochemical cell comprising:

the positive electrode, the positive electrode comprising a catalyst-doped material including composite particles individually comprising:

one of silicon dioxide ($SiO_2$) and silicon carbide (SiC); and one or more of Ru, Rh, Ni, Ir, Mo, Zn, and Fe;

a negative electrode comprising an additional cermet material comprising nickel and one or more of a yttrium- and ytterbium-doped barium-zirconate-cerate (BZCYYb) and a yttrium- and ytterbium-doped barium-strontium-niobate (BSNYYb); and a proton-conducting membrane between the positive electrode and the negative electrode and comprising one or more of further BZCYYb and further BSNYYb, the proton-conducting membrane having a $H^+$ conductivity greater than or equal to about $10^{-2}$ S/cm at one or more temperatures within a range of from about 400° C. to about 600° C.; and applying a potential difference between the positive electrode and the negative electrode of the electrochemical cell while the $CH_4$ interacts with the positive electrode so that hydrogen (H) atoms of the $CH_4$ release electrons ($e^-$) to produce methyl radicals ($CH_3^+$), hydrogen ions ($H^+$), and the $e^-$ through non-oxidative deprotonation of the $CH_4$ at the one or more temperatures.

2. The method of claim 1, further comprising selecting the proton-conducting membrane to comprise the further BSNYYb.

3. The method of claim 1, wherein the composite particles individually comprise one of:

Fe and $SiO_2$ (Fe@$SiO_2$);

Mo and $SiO_2$ (Mo@$SiO_2$);

Fe and SiC (Fe@SiC); and

Mo and SiC (Mo@SiC).

4. The method of claim 3, wherein the composite particles individually comprise the Fe@$SiO_2$.

5. The method of claim 1, further comprising selecting the proton-conducting membrane to comprise the further BZCYYb, the further BZCYYb comprising $BaZr_{0.3}Ce_{0.5}Y_{0.1}Yb_{0.1}O_{3-\delta}$.

6. The method of claim 1, further comprising selecting the proton-conducting membrane such that the proton-conducting membrane substantially intervenes between opposing surfaces of the positive electrode and the negative electrode.

7. The method of claim 1, wherein introducing $CH_4$ to the positive electrode of the electrochemical cell comprises introducing one or more fluid streams comprising the $CH_4$ to the positive electrode of the electrochemical cell.

8. The method of claim 1, further comprising selecting the proton-conducting membrane to be substantially homogeneous.

* * * * *